US007784750B2

(12) United States Patent
Burk

(10) Patent No.: US 7,784,750 B2
(45) Date of Patent: Aug. 31, 2010

(54) HAIR DRYER STAND

(76) Inventor: Lori Burk, 3850 Regent Dr., Dallas, TX (US) 75229

( * ) Notice: Subject to any disclaimer, the term of this patent is extended or adjusted under 35 U.S.C. 154(b) by 190 days.

(21) Appl. No.: 11/760,688

(22) Filed: Jun. 8, 2007

(65) Prior Publication Data

US 2007/0245590 A1 Oct. 25, 2007

Related U.S. Application Data

(63) Continuation-in-part of application No. 10/890,554, filed on Jul. 12, 2004, now Pat. No. 7,264,209.

(51) Int. Cl.
*F16M 11/00* (2006.01)

(52) U.S. Cl. ..... 248/176.2; 248/127; 248/117.2; 34/90

(58) Field of Classification Search ..... 248/176.2, 248/127, 146, 176.1, 117.1, 117.2, 117.7; 34/239, 90, 91, 97; 392/384
See application file for complete search history.

(56) References Cited

U.S. PATENT DOCUMENTS

| | | | | | |
|---|---|---|---|---|---|
| D198,488 | S | | 6/1964 | Reis | |
| 3,215,815 | A | * | 11/1965 | Lerner | 219/242 |
| 3,327,981 | A | * | 6/1967 | Yates | 248/117.2 |
| D253,305 | S | | 10/1979 | Battaglia | |
| 4,176,778 | A | * | 12/1979 | Fortune | 228/57 |
| 4,225,106 | A | | 9/1980 | Eplan | |
| 4,461,439 | A | | 7/1984 | Rose | |
| 4,696,447 | A | | 9/1987 | Strecker | |
| 4,826,049 | A | * | 5/1989 | Speer | 222/146.5 |
| 4,874,142 | A | | 10/1989 | Gelatt | |
| 4,878,642 | A | | 11/1989 | Kirby, Jr. | |
| D305,944 | S | | 2/1990 | Mellott | |
| D318,393 | S | | 7/1991 | Shea et al. | |
| 5,090,649 | A | | 2/1992 | Tipp | |
| D374,312 | S | | 10/1996 | Edgar | |
| 5,590,861 | A | | 1/1997 | Ardolino | |
| 5,613,305 | A | | 3/1997 | Narrin | |
| 5,636,815 | A | | 6/1997 | Wilson | |
| D394,370 | S | | 5/1998 | Hollinger | |
| 5,765,792 | A | | 6/1998 | Thomas | |
| 5,853,157 | A | * | 12/1998 | O'Donnell | 248/213.2 |
| 5,853,158 | A | | 12/1998 | Riggle | |
| D409,799 | S | | 5/1999 | Prochaska | |
| 5,988,572 | A | * | 11/1999 | Chivallier et al. | 248/176.1 |
| 6,109,581 | A | | 8/2000 | Kracke et al. | |

(Continued)

*Primary Examiner*—Anita M King
(74) *Attorney, Agent, or Firm*—Eugenia S. Hansen; Hemingway & Hansen, LLP

(57) ABSTRACT

A hair dryer stand for setting an operating blow-dryer on a countertop without burning the countertop or material on the countertop. The hair dryer stand is attractive and improves safety. The stand comprises at least one base, at least one sidewall having a top and a bottom where the bottom is attached to the base, at least one vent, and an opening wherein the opening profile is defined by the top of the sidewall and can receive the intake side of a blow-dryer that is turned on. In use, the blow-dryer is supported in the opening and suspended above the countertop. Air is allowed to flow into the intake side of the blow-dryer, over the heating coils inside blow-dryer and prevents the blow-dryer from overheating. Also, the exhaust side of the blow-dryer is directed upward, away from the countertop so the countertop or material on countertop will not burn.

12 Claims, 8 Drawing Sheets

U.S. PATENT DOCUMENTS

| | | | | |
|---|---|---|---|---|
| D435,938 | S | 1/2001 | Bushman | |
| 6,209,732 | B1 | 4/2001 | Dennis et al. | |
| 6,457,686 | B1 | 10/2002 | Hill | |
| D465,974 | S | 11/2002 | Dorion et al. | |
| 6,491,267 | B1 | 12/2002 | Feldman | |
| 6,601,813 | B1 | 8/2003 | Kager et al. | |
| 6,684,922 | B1 | 2/2004 | Alston et al. | |
| D510,517 | S | 10/2005 | Noack | |
| D512,686 | S | 12/2005 | Langley et al. | |
| 7,077,370 | B2 * | 7/2006 | Lin et al. | 248/176.2 |
| D532,657 | S | 11/2006 | Del Rosario | |
| D579,729 | S | 11/2008 | Pourounidis et al. | |

* cited by examiner

HAIR DRYER STAND

This application is a continuation-in-part application of application Ser. No. 10/890,554, filed Jul. 12, 2004, which is incorporated herein by reference.

BACKGROUND OF THE INVENTION

1. Technical Field

The present invention relates to the field of tool holders and, more particularly, to the area of holders for blow-dryers that retain blow-dryers in both operating and non-operating states.

2. Description of Related Art

Early hair dryers were large fixed appliances having a dome shaped hood under which a user would place their head. These devices, however, were cumbersome and could not be easily moved. In an attempt to provide mobility, manufacturers devised "portable" hair dryers. These, although movable, were still bulky and difficult to transport. More recently, handheld hair dryers ("blow-dryers") were introduced.

Blow-dryers are much smaller, easier to pack and carry and are commercially available in an assortment of sizes, strengths, and types. These devices are electrically driven and provide electrical heaters for heating air drawn in through an intake, over heating coils, and then directed through an exhaust nozzle. Typical units are gun-shaped providing a handle which allows one to hold the dryer and direct its air flow at the hair. Thereby a user may dry and style her hair.

Typically, a blow-dryer is held in one hand while the other hand is used to style the hair with a brush or other styling instrument. However, since one hand must be used to hold the blow-dryer, a user only has one hand available to style their hair. Sometimes a user needs both of her hands to style her hair. As recommended by manufacturers, this involves turning the blow-dryer off, setting it down on a countertop, styling the hair, and then turning the blow-dryer back on to finish styling the hair. The blow-dryer should be turned off because if the blow-dryer is set on a countertop while operating, the air intake has a much greater time collecting enough air to pass over the electric heaters and the blow-dryer could overheat, cause a fire, and creates a hazard in that it may fall into a sink containing water. Also, the hot air blown out of the exhaust nozzle may burn the countertop or material on the countertop.

Often it is difficult to turn the blow-dryer back on while keeping the hair styled in the desired position to be blow dried. Users frequently need both hands free to style their hair. Turning the blow-dryer on and off is a step most users do not like to do and therefor will often fail to turn off the blow-dryer.

While other blow-dryer stands have been developed, their usage has not become part of the typical household. First, other blow-dryer stands are cumbersome and bulky and designed to hold a blow-dryer in a fixed position. Fixed position holders negate the "handheld" aspect and convenience of a handheld blow-dryer. Other stands interfere with the continuous process of blow drying hair in that the blow-dryer must be non-operational while resting in the stand and/or deny quick and easy access to the blow-dryer handle. Some stands require attachment to a wall or countertop, which causes the loss of valuable wall or countertop space. Additionally, having a stand attached to the countertop is inconvenient as a homeowner is forced to make a relatively permanent change to her home's interior. All the above blow-dryer stands and holders require the user to change her hair drying routine.

When drying hair, many prefer to collect a section of hair in one of their hands or brush and then use and move the other hand holding the blow-dryer over that collected section of hair. When that section is dried, many users will set the blow-dryer upon the countertop and use both hands to collect a new section of hair. For reasons discussed above, this is problematic and dangerous. Prior art stands do not solve this problem without requiring a drastic change in the behavior and habit of the user.

What is needed is a blow-dryer stand that enables the user to leave the blow-dryer on when styling a section of hair. The stand should allow the intake of the blow-dryer to draw in enough air to prevent the blow-dryer from overheating. The stand should also direct the exhaust nozzle away from the countertop so as not to burn the countertop or material on the countertop. It should be durable, relatively inexpensive, and easy to use. Additionally, the stand should not require the user to change substantially her behavior in using the blow-dryer. An improved stand should also be attractive to the consumer so as to encourage display and usage of the stand.

SUMMARY OF THE INVENTION

The hair dryer stand of the present invention allows a user to set a blow-dryer (handheld hair dryer) on a countertop without having to turn the blow-dryer off. The blow-dryer stand can have many different profiles but each profile generally consists of at least one sidewall, a vent, and an opening for receiving an end of a blow-dryer. The hair dryer stand may be made from any durable material including plastic, metal, ceramic, and combinations thereof which is relatively durable and inexpensive to manufacture. Preferably, the stand may be comprised of acrylic, polyethylene, polyethylene, polyethylene glycol, high-density polyethylene, low density polyethylene, stainless steel, and combinations thereof . Also, because the hair dryer stand is a single unit with no moving parts or required fasteners the hair dryer stand is easy to use.

Another embodiment of the invention is a hair dryer stand that is curved in shape somewhat resembling a wave. The blow-dryer stand contains at least one base, a handle support, a dryer intake section, and a nozzle support. In this embodiment, it preferred to have two portions of the base connect with the surface supporting the stand. The first base is proximate to dryer intake section and the second base is proximate to the handle support. Handle support extends vertically up from dryer intake section and supports at least a portion of handle of a typical handheld blow-dryer. The nozzle support extends along one dimension between about 5 degrees to about 80 degrees from dryer intake section and away from handle support. In one embodiment, the end portion of handle support curves downward and extends to the surface used to support dryer stand and contains at least one base. Nozzle support may contain support walls comprised of a non-slipping material like rubber that extend vertically from nozzle support and help support an exhaust side of a handheld blow-dryer. This allows the blow-dryer to operate while resting securely on the blow-dryer stand as sufficient quantity of air available to the air intake of the dryer.

One object of the present invention is to provide a blow-dryer stand that allows a user to substantially use a blow-dryer stand without needing to change usage behavior. Another object of the present invention allows a user to leave the blow-dryer in an operating condition while the blow-dryer is resting on the stand. Another object of this invention is to provide a blow-dryer stand that leaves both of the user's hands free to brush, grab, braid, and otherwise manipulate the person's hair without having to turn off the blow-dryer.

Therefore, a blow-dryer stand made in accordance with the present invention is decorative and attractive. Because of numerous features and benefits of the stand, those who use blow-dryers are encouraged to use and display the stand, which may be used on virtually any planar surface such as a bathroom countertop or table. The stand improves safety by avoiding the placement of an operating blow-dryer directly onto a countertop thereby helping to reduce a fire and an electrocution hazard.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
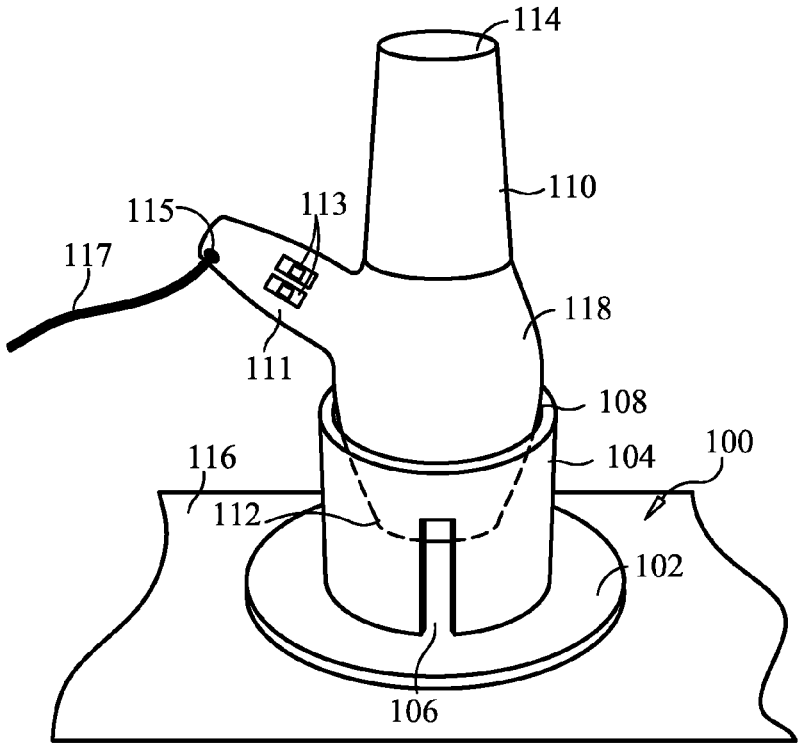
FIG. 1 is a plan view of a first embodiment of a tool holder in accordance with the present invention retaining a blow-dryer in a desired position.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings are indicated with like reference numerals and similar features as shown in alternate embodiments in the drawings are indicated with similar reference numerals.

Figure 2:
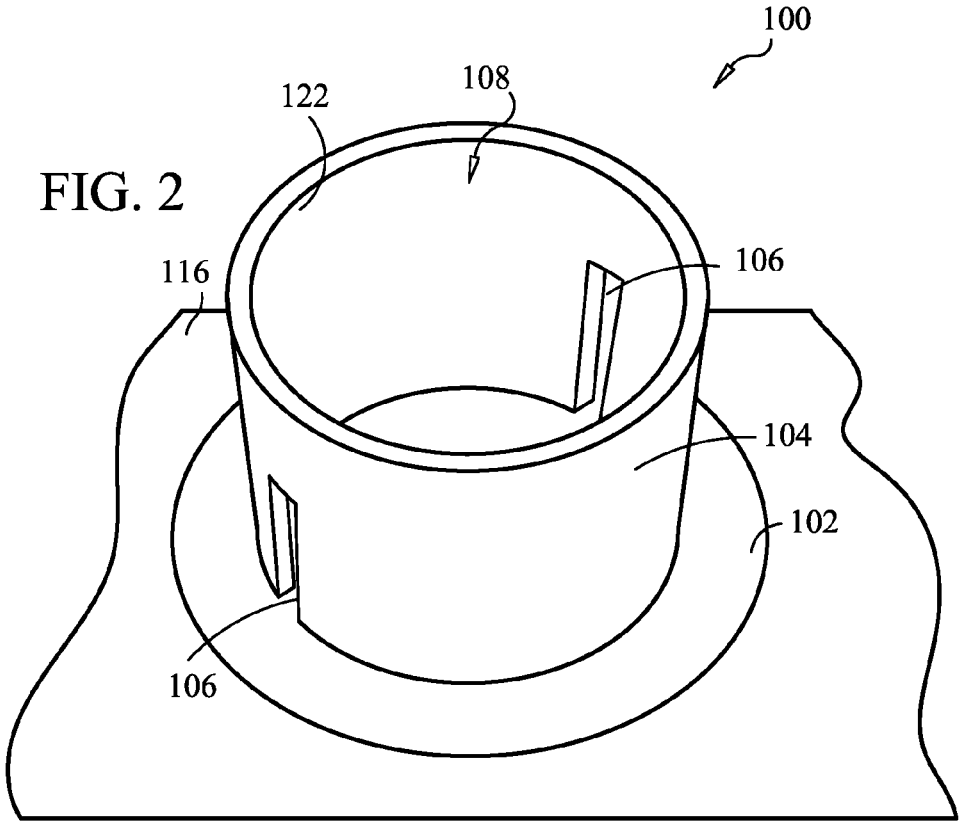
FIG. 2 is a perspective view of a first embodiment of a tool holder in accordance with the present invention.

FIGS. 1 and 2 depict one embodiment of hair dryer stand 100. FIGS. 1 and 2 depict optional base 102, sidewall 104, vent 106, opening 108, and countertop 116. Base 102 and sidewall 104 can be made of any material and may be made from any durable material including plastic, metal, ceramic, and combinations thereof which is relatively durable and inexpensive to manufacture. Preferably, the stand may be comprised of acrylic, polyethylene, polyethylene, polyethylene glycol, high-density polyethylene, low density polyethylene, or some other similar material. Optional base 102 may have a square, triangle, rectangle, circle, oval, hexagon or any polygon shape and is about 3 to about 18 inches at the widest part and is large enough to prevent tipping when a commercially available blow-dryer is placed in opening 108. Base 102 is optional because in an embodiment not shown stand 100 is formed such that the width or diameter and the proportion of weight to height of stand 100 are sufficiently large enough to provide a center of gravity that is low enough to support the weight of numerous typical blow-dryers and not collapse. Sidewall 104 is continuous and forms the shape of a square, triangle, rectangle, circle, oval, hexagon, or polygon. Inside wall 122 of sidewall 104 defines opening 108.

Opening 108 extends the length of sidewall 104 and may have a square, triangle, rectangle, circle, oval, hexagon, or polygon shape. Opening 108 is large enough to allow intake side 112 to pass through and is about 2 to about 6 inches at the widest part. Sidewall 104 is fixedly attached to and extends about 4 to about 24 inches vertically from base 102. Countertop 116 is a typical countertop found in a bathroom, hair salon, or any other place people may style their hair. Base 102 rests on countertop 116. In the optional embodiment not utilizing a base, the lower edge of sidewall 104 would rest on countertop 116 in place of base 102.

Hair dryer stand 100 is used with a commercially available blow-dryer 110 such as the YELLOWBIRD available from the Conair Corporation located in Stamford, Conn., or the MIDNIGHT SILVER 2000 9190U available from the Revlon Corporation located in New York, N.Y. Blow-dryer 110 has an intake side 112 and an exhaust side 114 and is inserted into opening 108 such that intake side 112 is proximate to base 102. Design bulge 118 on blow-dryer 110 prevents blow-dryer 110 from touching base 102 and suspends blow-dryer 110 at least about 0.25 inches above base 102. Advantageously, hair dryer stand 100 leaves blow-dryer handle 111 accessible such that control 113 may be manipulated while blow-dryer 110 is resting in stand 100. Also, the design of stand 100 allows electrical cord 117 to extend from an electricity port 115 without interfering with the operation and use of hair dryer stand 100. For blow-dryers that do not have a design bulge, the handle of the blow-dryer prevents the blow-dryer from touching base 102.

By suspending blow-dryer 110 above base 102, air is allowed to flow into intake side 112 and over the heating coils inside blow-dryer 110. This prevents blow-dryer 110 from overheating, causing a fire, or falling into a sink containing water. Also, exhaust side 114 is directed upward, away from countertop 116 so countertop 116 or material on countertop 116 will not burn.

Vent 106 allows passage of air to opening 108 and further increases the flow of air to intake side 112 of blow-dryer 110. Vent 106 can be any shape that will permit sufficient airflow such as a triangle, circle, oval, hexagon, polygon, or any shape allowing sufficient airflow. Furthermore, the shape may appear be decorative and aesthetically pleasing while still providing the needed airflow to the blow-dryer intake. Vent 106 is located proximate to base 102 and is orientated to maximize the air flow to intake side 112 and prevent blow-dryer 110 from overheating. The height of vent 106 can be any height but is typically no longer than half the length of sidewall 104. There may be multiple vents 106.

Figure 3:
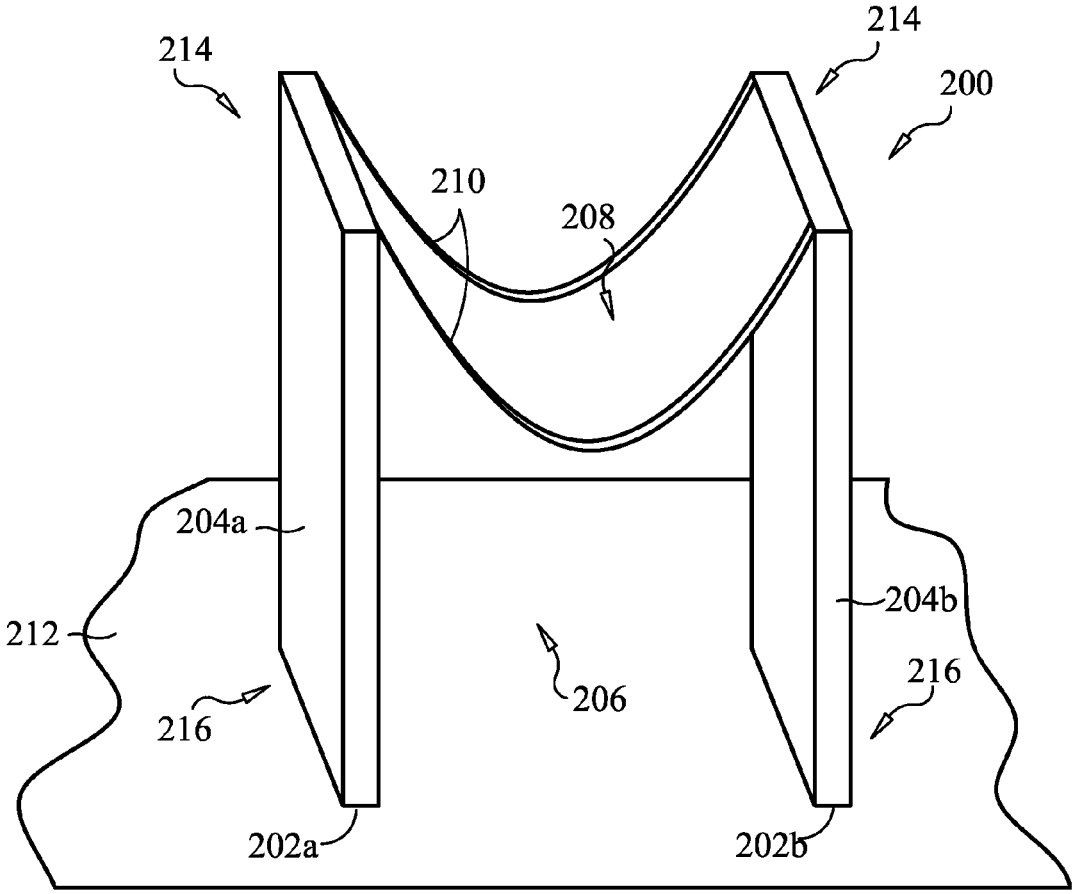
FIG. 3 is a perspective view of a second embodiment of a tool holder in accordance with the present invention.
Figure 4:
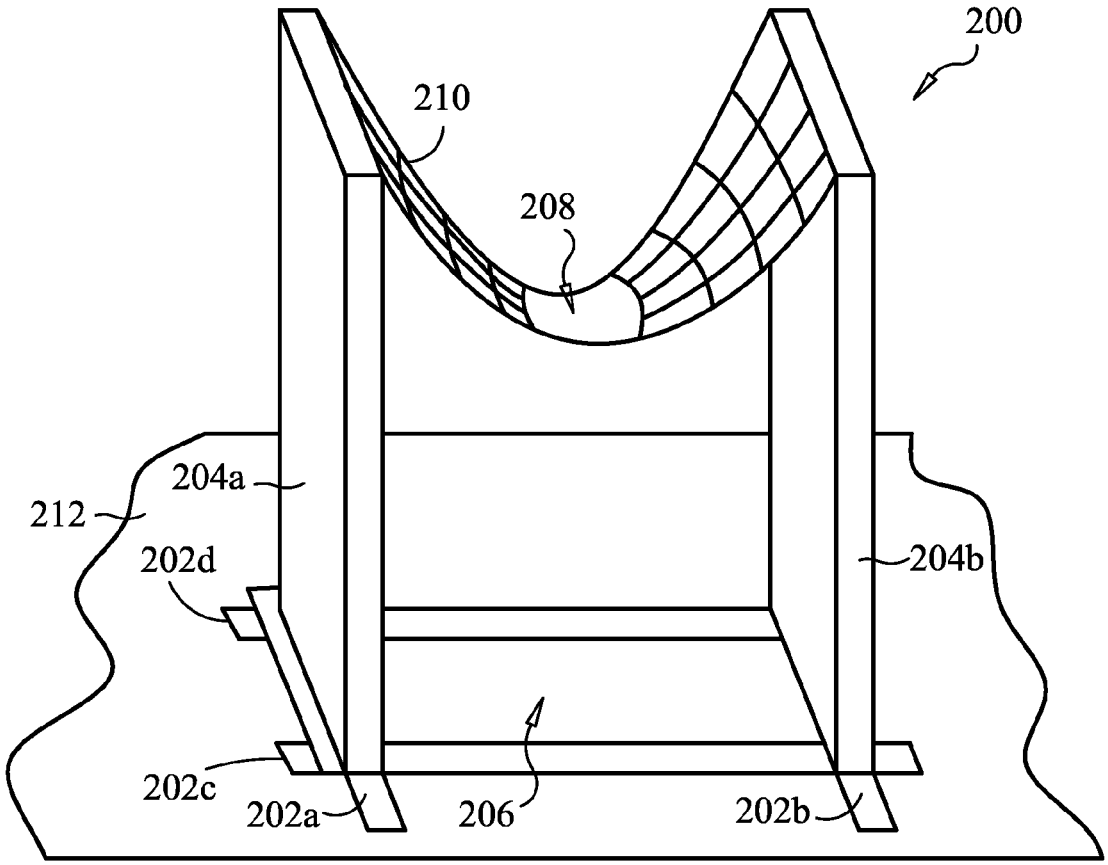
FIG. 4 is a perspective view of a third embodiment of a tool holder in accordance with the present invention.
Figure 5:
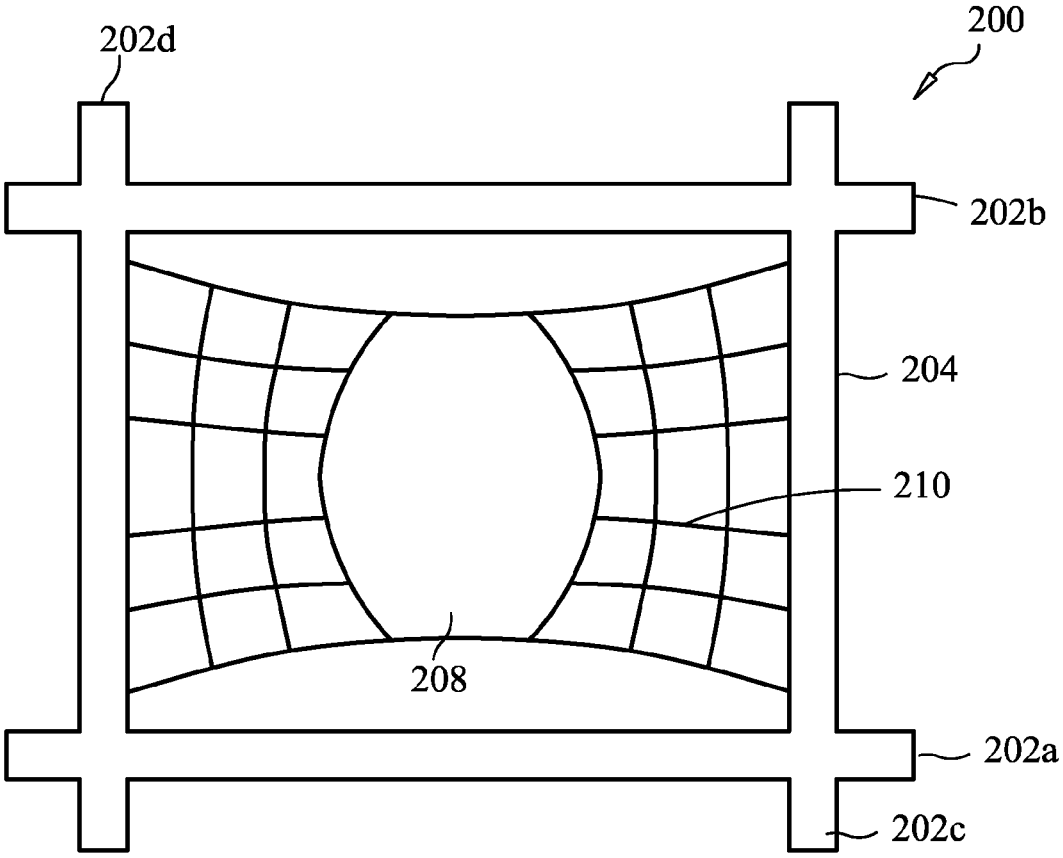
FIG. 5 is a bottom view of the tool holder shown in FIG. 4.

FIGS. 3, 4, and 5 depict one embodiment of hair dryer stand 200. FIG. 3 depicts base 202*a* and 202*b*, sidewall 204*a* and 204*b*, vent 206, opening 208, bridge 210, and countertop 212. Base 202*a* and 202*b* and sidewall 204*a* and 204*b* may be made of any material and may be made from any durable material including plastic, metal, ceramic, and combinations thereof which is relatively durable and inexpensive to manufacture. Preferably, the stand may be comprised of acrylic, polyethylene, polyethylene, polyethylene glycol, high-density polyethylene, low density polyethylene, or some other similar material. Sidewall 204*a* and 204*b* have a top 214 and a bottom 216. Base 202*a* and 202*b* are at the bottom 216 of sidewall 204*a* and 204*b* respectively. Countertop 212 is a typical countertop found in a bathroom, hair salon, or any other place people may style their hair.

Sidewalls 204*a* and 204*b* are parallel to each other and supported by base 202*a* and 202*b*. Base 202*a* and 202*b* are in contact with and rest on countertop 212. Bridge 210 is fixedly attached to sidewall 204*a* and 204*b* at top 214 and provides additional support for sidewalls 204*a* and 204*b*. Bridge 210 can be made of any material and may be made of acrylic, polyethylene, polyethylene, polyethylene glycol, high-density polyethylene, low density polyethylene or some other similar rigid material as shown in FIGS. 3 or heat resistant mesh, rope or cord as shown in FIGS. 4 and 5. If base 202*a* and 202*b*, sidewalls 204*a* and 204*b*, and bridge 210 are made of the same material, then hair drying stand 200 may be extruded as a single piece thereby making the manufacturing process relatively inexpensive.

Opening 208 may extend the length of bridge 210 as shown in FIG. 3, or may be a square, triangle, rectangle, circle as shown in FIGS. 4 and 5, oval, hexagon or any polygon. Opening 208 is large enough to allow the intake side of blow-dryer 110 to pass through and is about 2 to about 6 inches in diameter at the widest part.

In use, the blow-dryer 110 is inserted into opening 208 such that the intake side 112 is relatively proximate to countertop 212. Design bulge 118 on blow-dryer 110 prevents the blow-dryer 110 from touching countertop 212 and suspends blow-dryer 110 at least about 0.25 inches above countertop 212. For blow-dryers that do not have a design bulge, the handle of the blow-dryer prevents the blow-dryer from touching countertop 212.

FIGS. 4 and 5 depict hair dryer stand 200 having additional support base 202*c* and 202*d*. Addition support base 202*c* and 202*d* are parallel to each other and perpendicular to and on the same plane as base 202*a* and 202*b*.

By suspending blow-dryer 110 above countertop 212, air is allowed to flow into intake side 112, over the heating coils inside blow-dryer 110 and prevent blow-dryer 110 from overheating, causing a fire, or falling into a sink containing water. Also, exhaust side 114 is directed upward, away from countertop 212 so countertop 212 or material on countertop 212 will not burn. Vent 206 is defined by the space between sidewalls 204*a* and 204*b* and bridge 210 and allows for the flow of air into the intake side 112 of blow-dryer 110.

Figure 6:
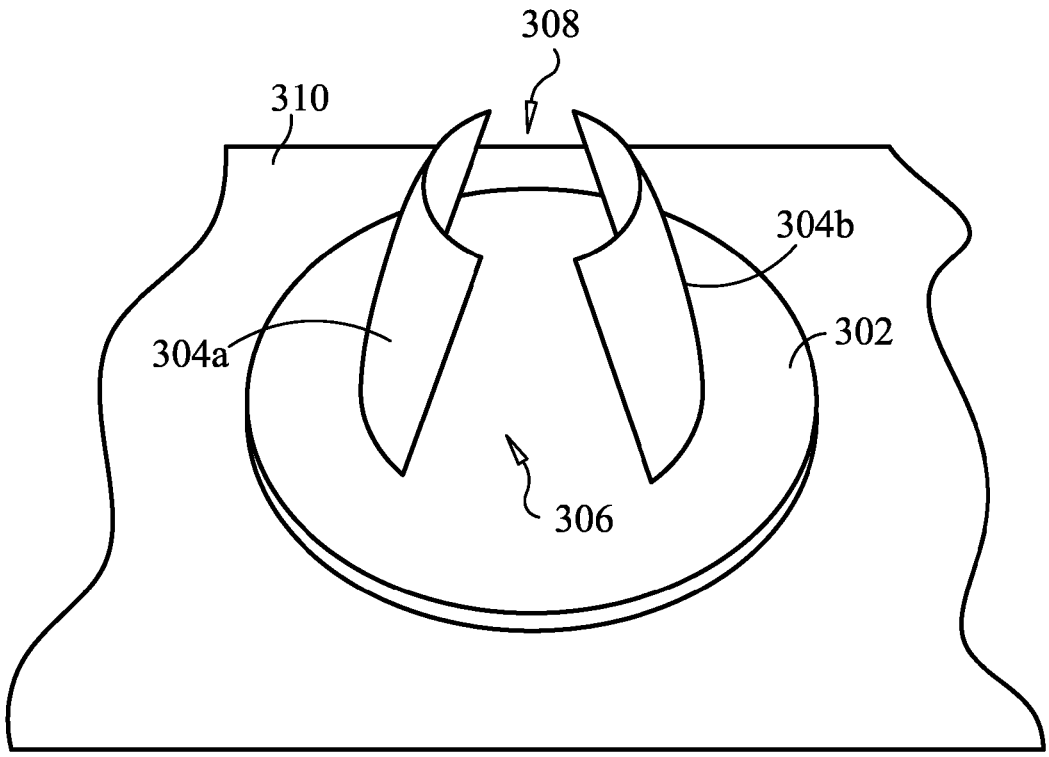
FIG. 6 is a perspective view of a fourth embodiment of a tool holder in accordance with the present invention.
Figure 7:
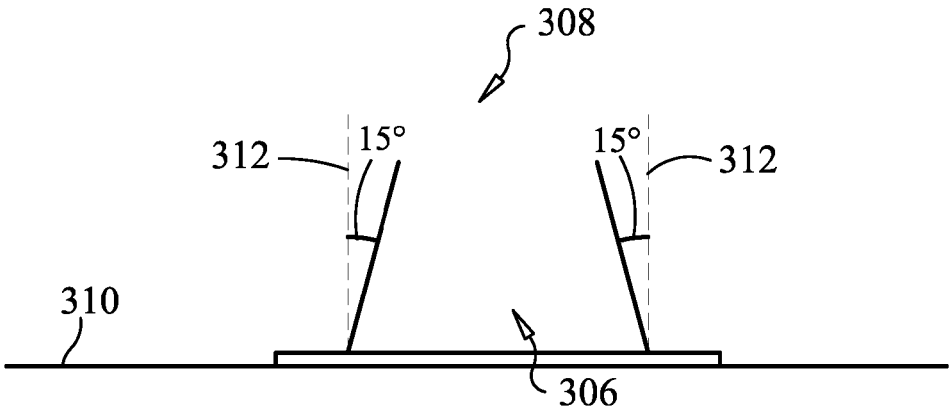
FIG. 7 is a cross sectional plan view of the tool holder shown in FIG. 6.

FIG. 6 is a perspective view and FIG. 7 is a cross-sectional plan view of one embodiment of the hair dryer stand. FIGS. 6 and 7 depict base 302, sidewalls 304*a* and 304*b*, vent 306, opening 308, and countertop 310. Base 302 and sidewall 304 can be made of any material and may be made from any durable material including plastic, metal, ceramic, and combinations thereof which is relatively durable and inexpensive to manufacture. Preferably, the stand may be comprised of acrylic, polyethylene, polyethylene, polyethylene glycol, high-density polyethylene, low density polyethylene, or some other similar material. Countertop 310 is a typical countertop found in a bathroom, hair salon, or any other place people may style their hair. Base 302 is in contact with and rests on countertop 310.

Sidewalls 304*a* and 304*b* extend upward from base 302 at an angle such that the ends of each sidewall are converging to each other. While depicted as mirror images, sidewalls 304*a* and 304*b* do not need to be identical providing that they converge towards each other and can support at least a blow-dryer in the desired position. Sidewalls 304*a* and 304*b* may be round, oval, square, rectangular, triangular, hexagon or any other polygon. Sidewalls 304*a* and 304*b* may have a curved profile and are fixedly attached to and supported by base 302. In one embodiment, sidewall 304*a* and 304*b* extend about 4 to about 24 inches vertically from base 302 at an angle from about 0 to about 4 to about 5 degrees relative to plane 312, which is perpendicular to base 302. See FIG. 7. For example, in one embodiment, as shown in FIG. 7, sidewall 304*a* and 304*b* extend from base 302 at an angle of about 15 degrees relative to plane 312.

In use, the blow-dryer 110 is inserted into opening 308 such that the intake side 112 is relatively proximate to base 306. Opening 308 may be a square, triangle, rectangle, circle, oval, hexagon or any polygon shape and is defined by sidewall 304*a* and 304*b*. Opening 308 is large enough to allow the intake side 112 of the blow-dryer 110 to pass through and is typically about 2 to about 6 inches at the widest part. The design bulge 118 on the blow-dryer 110 prevents the blow-dryer 110 from touching base 302 and suspends the blow-dryer 110 at least about 0.25 inches above base 302. For blow-dryers that do not have a design bulge, the handle of the blow-dryer prevents the blow-dryer from touching countertop 310.

By suspending the blow-dryer 110 above base 302, air is allowed to flow into the intake side 112, over the heating coils inside the blow-dryer 110 and prevent the blow-dryer 110 from overheating, causing a fire, or falling into a sink containing water. Vent 306 is defined by the space between sidewall 304*a* and 304*b* and opening 308 and allows for the flow of air to the intake side 112 which prevents the blow-dryer 110 from overheating. Also, the exhaust side 114 is directed upward, away from countertop 310 so countertop 310 or material on countertop 310 will not burn.

Figure 8:
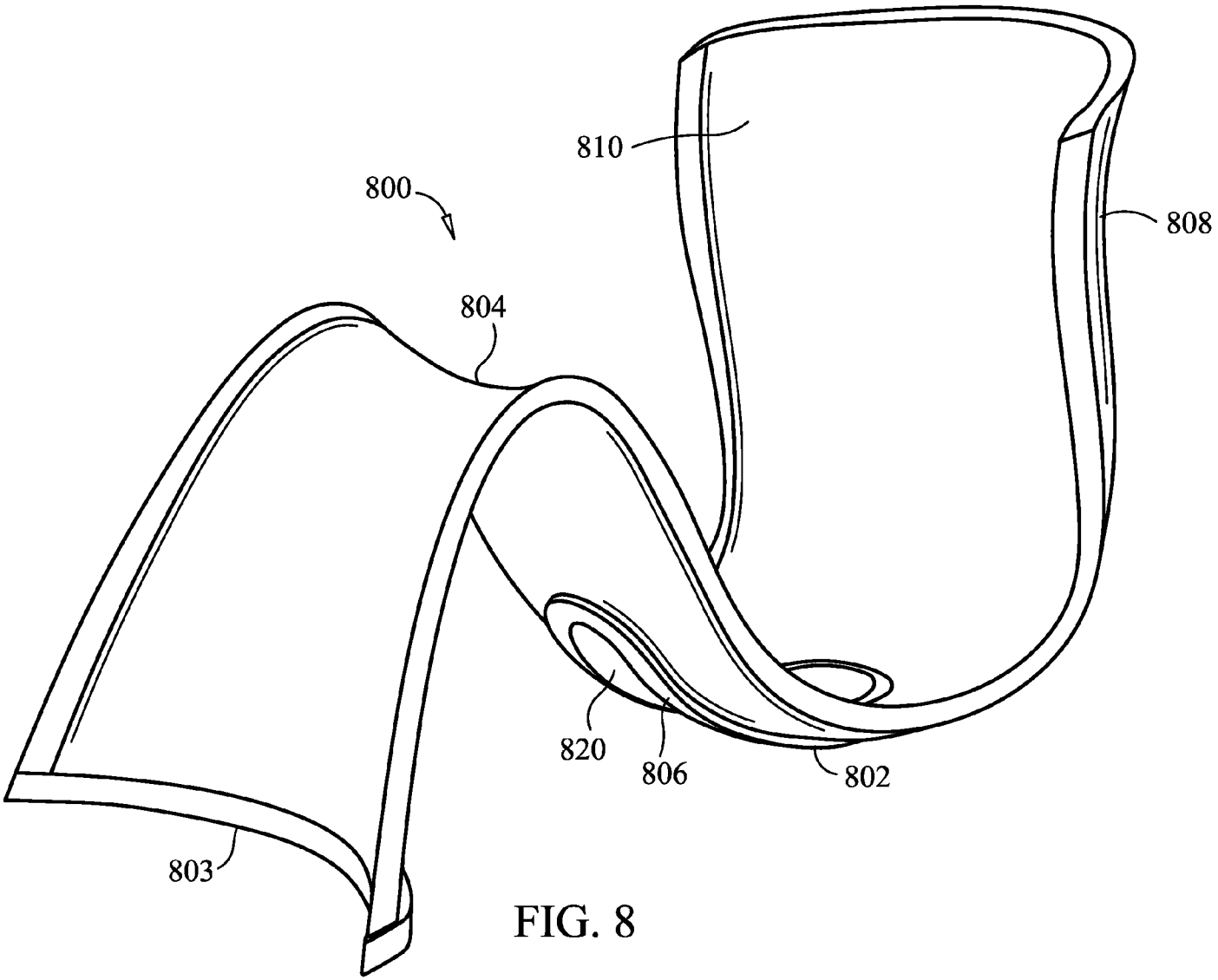
FIG. 8 is a perspective view of an alternate embodiment in accordance with the present invention.

In another embodiment, shown in FIG. 8, hair dryer stand 800 contains at least one base 802, handle support 804, dryer intake section 806, and nozzle support 808. At least one base 802 supports dryer stand 800 and in one preferred embodiment there are two bases 802 and 803. Base 802 is proximate to dryer intake section 806. Base 803 is proximate to handle support 804. Handle support 804 extends vertically up from dryer intake section 806 and is of sufficient width and length to support at least a portion of handle of a typical handheld blow-dryer. Nozzle support 808 extends between about 5 degrees to about 80 degrees from dryer intake section 806 and away from handle support 804. In one embodiment, the end portion of handle support 804 curves downward and extends to the counter top or surface used to support dryer stand 800 and contains at least one base 803. While dryer stand 800 terminates at base 803, other embodiments not shown may extend upward from the counter top. Nozzle support 808 may contain support walls 810 that extend vertically from nozzle support 808 and help support an exhaust side of a handheld blow-dryer.

Figure 9:
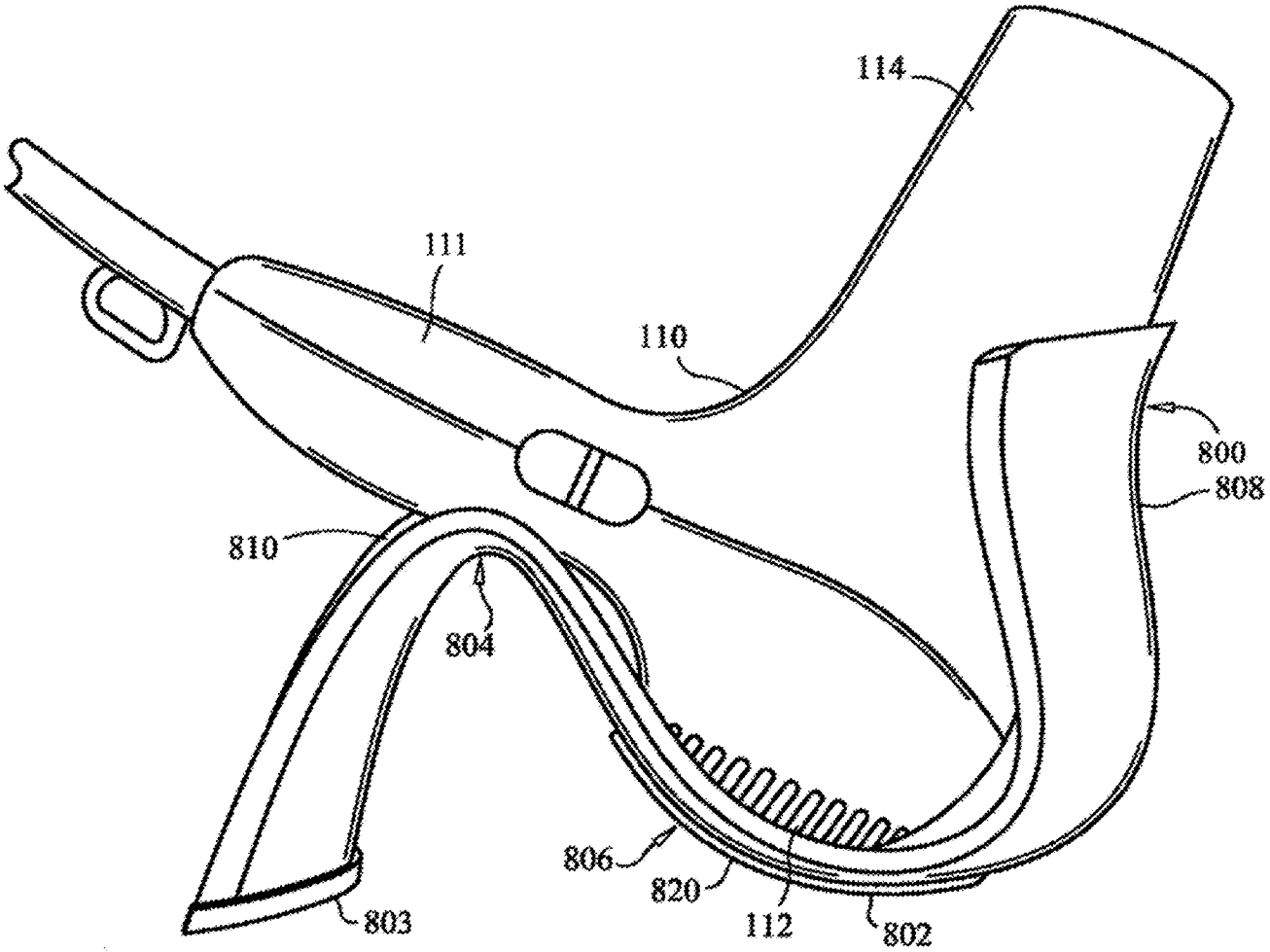
FIG. 9 is a perspective view of the alternate embodiment shown in FIG. 8 supporting a handheld blow-dryer.

In FIG. 9, hair dryer stand 800 is shown supporting a handheld blow-dryer 110. Nozzle support 808 extends vertically up from dryer intake section 806 and is of sufficient width and length to support at least a portion of exhaust side 114 of blow-dryer 110. Handle support 804 extends between about 5 degrees to about 80 degrees from dryer intake section 806 and away from nozzle support 808. Intake 806 forms a sufficient opening within stand 800 so that an operating blow-dryer intake section 806 may receive enough air to allow proper operation of an operating blow-dryer.

Dryer stand 800 may be used with a commercially available blow-dryer 110 such as the YELLOWBIRD available from the Conair Corporation located in Stamford, Conn., or the MIDNIGHT SILVER 2000 9190U available from the Revlon Corporation located in N.Y, N.Y. Blow-dryer 110 contains handle 111, intake side 112 and exhaust side 114. In use, handle 111 is supported by handle support 804, intake side 112 is supported by dryer intake section 806, and exhaust side 114 is supported by nozzle support 808. Because exhaust side 114 is elevated by nozzle support 808, the hot air expelled by exhaust side 114 will not burn countertop or material on or proximate to countertop 310. In one embodiment, dryer intake section 806 contains at least one channel 820 to allow air to easily flow into intake side 112 of blow-dryer 110.

Figure 10:
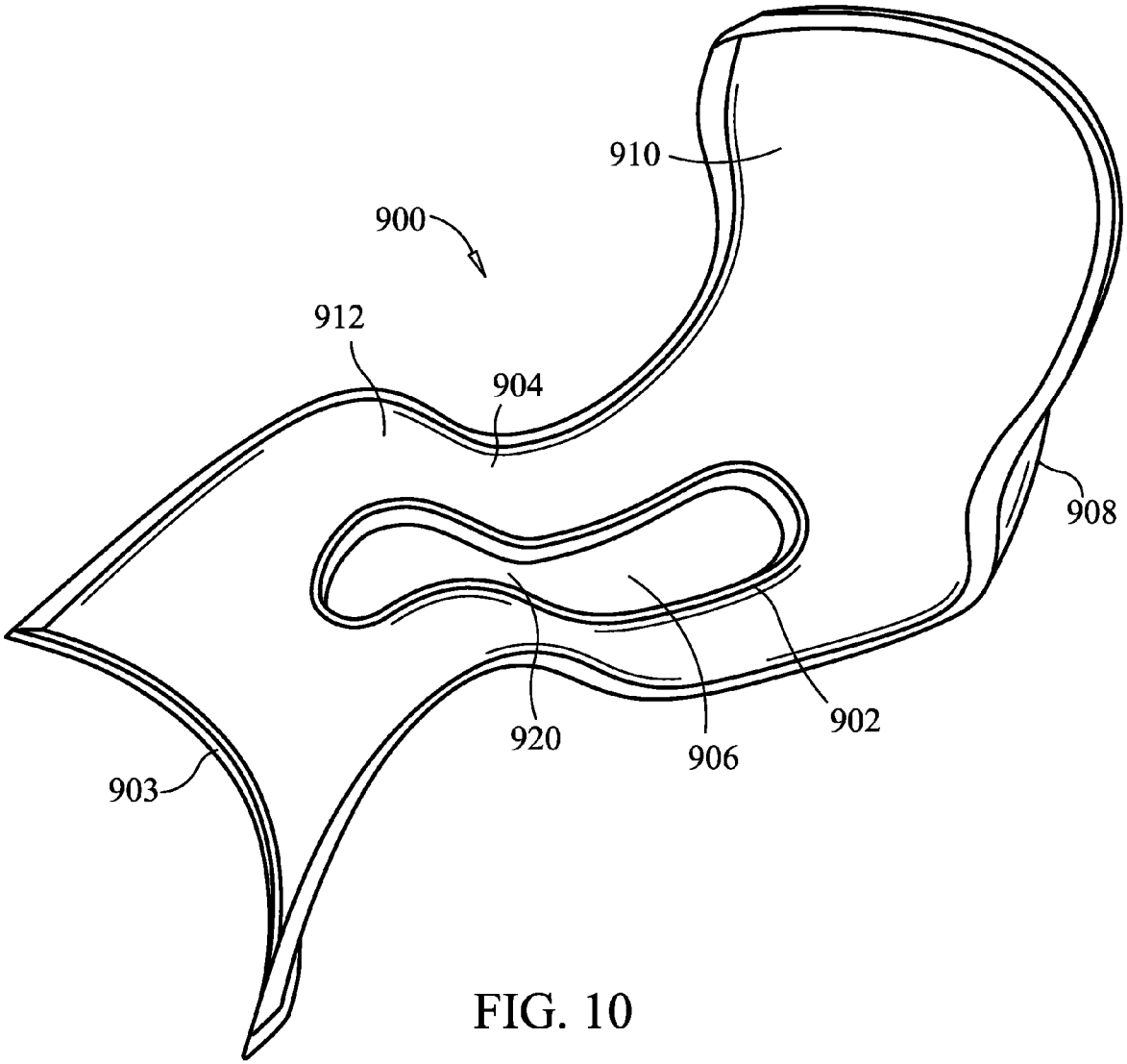
FIG. 10 is a perspective view of an alternate embodiment in accordance with the present invention.

In another embodiment shown in FIG. 10, hair dryer stand 900 contains at least one base 902, handle support 904, dryer intake section 906, and nozzle support 908. At least one base 902 supports dryer stand 900 and in one preferred embodiment there are two bases 902 and 903. Base 902 is proximate to dryer intake section 906. Base 903 is proximate to handle support 904. Handle support 904 extends vertically up from dryer intake section 906 and is of sufficient width and length to support at least a portion of handle of a typical handheld blow-dryer. Nozzle support 908 extends between about 5 degrees to about 80 degrees from dryer intake section 906 and away from handle support 904. The end portion of handle support 904 curves downward and extends to the counter top or surface used to support dryer stand 900 and contains at least one base 903. In this embodiment, dryer intake section 906 forms the start of at least one channel 920 that extends up from approximately base 902 up to peak 912 and continues on toward base 903. In a preferred embodiment, channel 920 starts out wider at about base 902 and narrows as channel 920 continues up to peak 912. Channel 920 forms a gap in stand 900 at about handle support 904 that in turn helps support and hold steady a hair dryer being supported on stand 900. Nozzle support 908 may contain support walls 910 that extend vertically from nozzle support 908 and help support an exhaust side of a handheld blow-dryer.

Hair dryer stand may be comprised of steel, marble, plastic, or any other material able to support a hair dryer and withstand the elevated temperatures of an operating hair dryer such as for example of at least 125 degrees Fahrenheit. Hair dryer stand may be modified and used with other tools such as a curling iron, hair crimper, glue gun, soldering iron, or other such electronic devices having a relatively cool handle end and a relatively hot heat producing end that can produce temperatures over 125 degrees Fahrenheit. The modifications may include narrowing or widening the opening to accommodate holding the handle end of the desired tool such that the heat producing end is not proximate to a countertop or material on the countertop, increasing or decreasing the size or number of vents, increasing or decreasing the size of the base, or other such modifications which would prevent the tool from overheating, causing a fire, or falling into a sink or container of water.

With the blow-dryer stands of the present invention, a user may leave the blow-dryer on when styling a section of hair. The stands allow the intake of the blow-dryer to draw in enough air to prevent the blow-dryer from overheating. The stands direct the exhaust nozzle away from the countertop so as not to burn the countertop or material on the countertop. Further, the blow-dryer stands are attractive, durable, relatively inexpensive, and easy to use. Advantageously, the blow-dryer stand does not require the user to change substantially her behavior in using the blow-dryer. As the blow-dryer stand is attractive, advantageous, and relatively inexpensive, consumers are encouraged to display and use a blow-dryer stand that not only improves safety but is also pleasing to the eye.

While the invention has been particularly shown and described with reference to one or more preferred embodiments, it will be understood by those skilled in the art that various changes in form and detail may be made therein without departing from the spirit and scope of the invention.

What is claimed is:

1. A hair dryer stand for holding a blow-dryer wherein the blow-dryer has an intake side and an exhaust side wherein said hair dryer can be turned on or off, the hair dryer stand comprising:

a nozzle support section;

a first base section defined adapted to rest upon a surface in use;

a handle support section;

said first base section proximate to and defined by said nozzle support section and said handle support section;

a dryer intake section for receiving said intake side of said blow dryer, said dryer intake section defined by said first base and said handle support section;

at least one channel defined by said dryer intake section, said channel providing an opening through which a hair dryer resting on said stand may intake air;

said handle support section extending generally vertically upwardly from said dryer intake section;

a second base proximate to and extending downwardly from said handle support section, said second base adapted to rest upon a surface when in use.

2. The hair dryer stand of claim 1 wherein the nozzle support section extends upwardly between about 5 degrees to about 80 degrees from said dryer intake section.

3. The hair dryer stand of claim 1 wherein the at least one channel is proximate to said first base section.

4. The hair dryer stand of claim 1 wherein said nozzle support section further comprises support walls which extend vertically from said nozzle support section whereby said exhaust side of said blow dryer is further supported.

5. The hair dryer stand of claim 4 wherein said support walls curve inwardly to form a shape adapted to receive a nozzle of said hair dryer.

6. The hair dryer stand of claim 1 wherein the at least one channel extends from the first base section upwardly in said handle support section toward an apex of said handle support section.

7. The hair dryer stand of claim 6, wherein said channel is wider at said first base section and narrows as it extends upwardly in said handle support section.

8. The hair dryer stand of claim 6, wherein said channel extends upwardly to said handle support section apex.

9. The hair dryer stand of claim 6, wherein said channel extends upwardly to said handle support section and continues past said handle support section apex toward said second base.

10. The hair dryer stand of claim 1,wherein said stand extends upwardly from said first base to said handle support apex so that at least a portion of said dryer intake section is spaced apart from a surface on which said stand is placed to enable air to flow through said channel into said dryer's intake side.

11. The hair dryer stand of claim 10, wherein said spaced apart distances is at least about 0.25 inches up from said first base.

12. A tool holder for holding a tool wherein the tool has a handle end and a heat producing end and the handle end is relatively cool to the touch and the heat producing end can produce temperatures over about 125 degrees Fahrenheit when said tool is turned on, the tool holder comprising:

a heat producing end support section adapted to receive said heat producing end of said tool;

a first base section adapted to rest upon a surface in use;

a handle support section;

said first base section proximate to and defined by said heat producing end support section and said handle support section;

said handle support section extending generally vertically upwardly from said first base and culminating in a handle support apex;

a second base proximate to and extending downwardly from said handle support apex, said second base adapted to rest upon a surface when in use;

wherein said first base and said handle support section together define a vent through which said tool may intake air.

* * * * *